US010744384B1

(12) United States Patent
Bruce

(10) Patent No.: US 10,744,384 B1
(45) Date of Patent: Aug. 18, 2020

(54) INVERTED DUNK TANK

(71) Applicant: Garry Bruce, Pottstown, PA (US)

(72) Inventor: Garry Bruce, Pottstown, PA (US)

( * ) Notice: Subject to any disclaimer, the term of this patent is extended or adjusted under 35 U.S.C. 154(b) by 0 days.

(21) Appl. No.: 16/585,056

(22) Filed: Sep. 27, 2019

Related U.S. Application Data

(60) Provisional application No. 62/810,484, filed on Feb. 26, 2019.

(51) Int. Cl.
*A63B 67/00* (2006.01)
*A63B 47/00* (2006.01)
*F41J 5/22* (2006.01)

(52) U.S. Cl.
CPC ..... *A63B 67/002* (2013.01); *A63B 47/002* (2013.01); *F41J 5/22* (2013.01); *A63B 2220/801* (2013.01); *A63B 2220/833* (2013.01); *A63B 2225/60* (2013.01)

(58) Field of Classification Search
CPC ..... F41J 5/22; A63B 67/002; A63B 47/002; A63B 2220/801; A63B 2220/833; A63B 2225/60
See application file for complete search history.

(56) References Cited

U.S. PATENT DOCUMENTS 3,649,025 A * 3/1972 Garland ..... A63B 47/025 473/157
4,702,480 A 10/1987 Popeski et al.
5,586,767 A * 12/1996 Bohland ..... A63B 67/00 273/349
5,634,642 A 6/1997 Grandolfo
5,855,372 A * 1/1999 Thiemann ..... A63B 67/002 273/349
6,666,456 B1 * 12/2003 Swankie ..... E06C 1/34 182/189
8,702,104 B2 * 4/2014 Legary ..... F41J 5/056 273/371
8,770,586 B2 7/2014 Kody et al.
9,415,318 B1 8/2016 Harris
2014/0265134 A1 9/2014 Cello

* cited by examiner

*Primary Examiner* — Jeffrey S Vanderveen
(74) *Attorney, Agent, or Firm* — Boudwin Intellectual Property; Daniel Boudwin

(57) ABSTRACT

An inverted dunk tank including a frame attached to a trailer. The frame supports a plurality of water tanks in an upper section of the frame. The plurality of water tanks is each connected to a water release valve respectively. At least one sidewall is attached to the frame. The at least one sidewall has a plurality of holes located therein. Each of the plurality of holes has a sensor therein. The sensors detect when an item passes through the hole. The sensor will send a signal to the water release valve and dump water from the tank.

11 Claims, 5 Drawing Sheets

INVERTED DUNK TANK

CROSS REFERENCE TO RELATED APPLICATIONS

This application claims the benefit of U.S. Provisional Application No. 62/810,484 filed on Feb. 26, 2019. The above identified patent application is herein incorporated by reference in its entirety to provide continuity of disclosure.

BACKGROUND OF THE INVENTION

The present invention relates to dunk tanks. More particularly, the present invention provides an inverted dunk tank that drops water onto a person instead of dropping a person into a water tank.

Many people enjoy the use of dunk tanks. Dunk tanks are used for all kinds of reasons. They can be found at fairs and at fundraisers throughout the country. Dunk tanks can be a fun way to earn money. Traditionally, a payment is given in exchange for several objects to throw at a target. The target used to be a mechanical target where the throwable object had to hit the target with an amount of force required to release a seat. Once the seat was released, an individual would be dropped into a vat of water. In many cases, multiple individuals each day would get dunked into the vat.

The old system has several drawbacks. First, the target could stick and not release when hit. That means that even if the target is hit the person may not be dropped into the water. This can be upsetting for children that may not be able to put a large amount of force behind their throw. A second issue with the old method is the vat of water. Without changing the water, the water can become dirty and spread germs and illness. Another issue with the traditional system is the seat. When the seat is released in a traditional dunk tank, it drops down and away. If a person to be dunked is not sitting in the properplace on the seat, they could not clear the seat. This means that they could be potentially injured from the dunk tank.

Consequently, there is a need in for an improvement in the art of dunk tanks. The present invention substantially diverges in design elements from the known art while at the same time solves a problem many people face when using dunk tanks in a safe and fun manner. In this regard the present invention substantially fulfills these needs.

SUMMARY OF THE INVENTION

The present invention provides an inverted dunk tank wherein the same can be utilized for providing convenience for the user when using a dunk tank. The present system comprises a frame. A water tank is located in an upper section of the frame. A water release valve is connected to a bottom section of the water tank. A wall is attached to a side section of the frame. The wall has a plurality of apertures therethrough. Each aperture has a sensor that detects when an item is passed through the aperture. The sensors are operably coupled to the water release valve.

Another object of the invention is to provide an inverted dunk tank that comprises a frame, connected to a trailer, wherein the trailer is capable of attaching to a vehicle. A water tank is located in an upper section of the frame. A water elease valve is connected to a bottom section of the water tank. A wall is attached to a side section of the frame. The wall has a plurality of apertures therethrough. Each aperture has a sensor that detects when an item is passed through the opening of an aperture. The sensors are operably coupled to the water release valve.

Other objects, features and advantages of the present nvention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
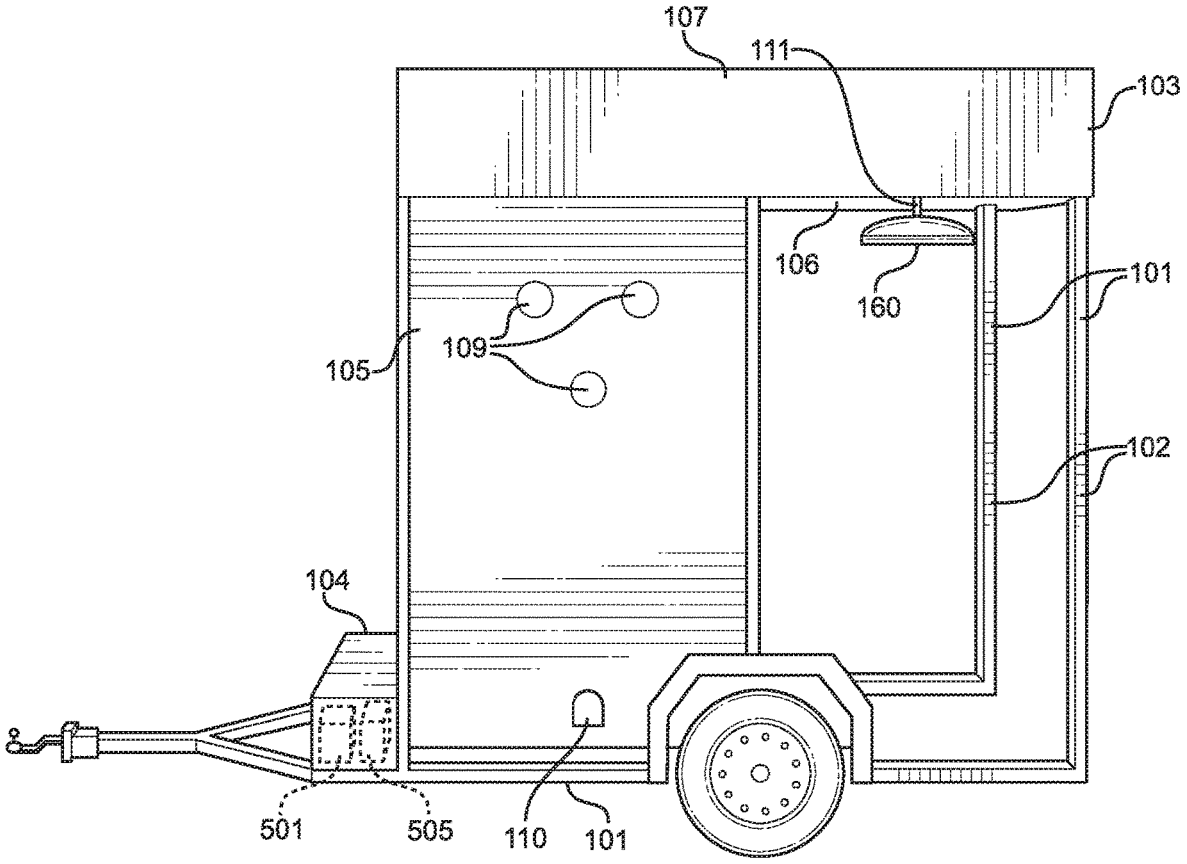
FIG. 1 shows a perspective front view of an embodiment of the inverted dunk tank.

Reference is made herein to the attached drawings. Like reference numerals are used throughout the drawings to depict like or similar elements of the inverted dunk tank. For the purposes of presenting a brief and clear description of the present invention, a preferred embodiment will be discussed as used for the inverted dunk tank. The figures are intended for representative purposes only and should not be considered to be limiting in any respect.

Referring now to FIG. 1, there is shown a perspective front view of an embodiment of the inverted dunk tank. The inverted dunk tank does not have the traditional tank. The inverted dunk tank has a frame 101 that supports the structure. The frame 101 is made from a plurality of support columns 102. In one embodiment, the frame 101 is made from PVC. In one embodiment, the frame 101 is made from a lightweight metal such as aluminum or other suitable metals. The frame 101 supports an upper section 103, a chest 104, and a wall 105.

Figure 3:
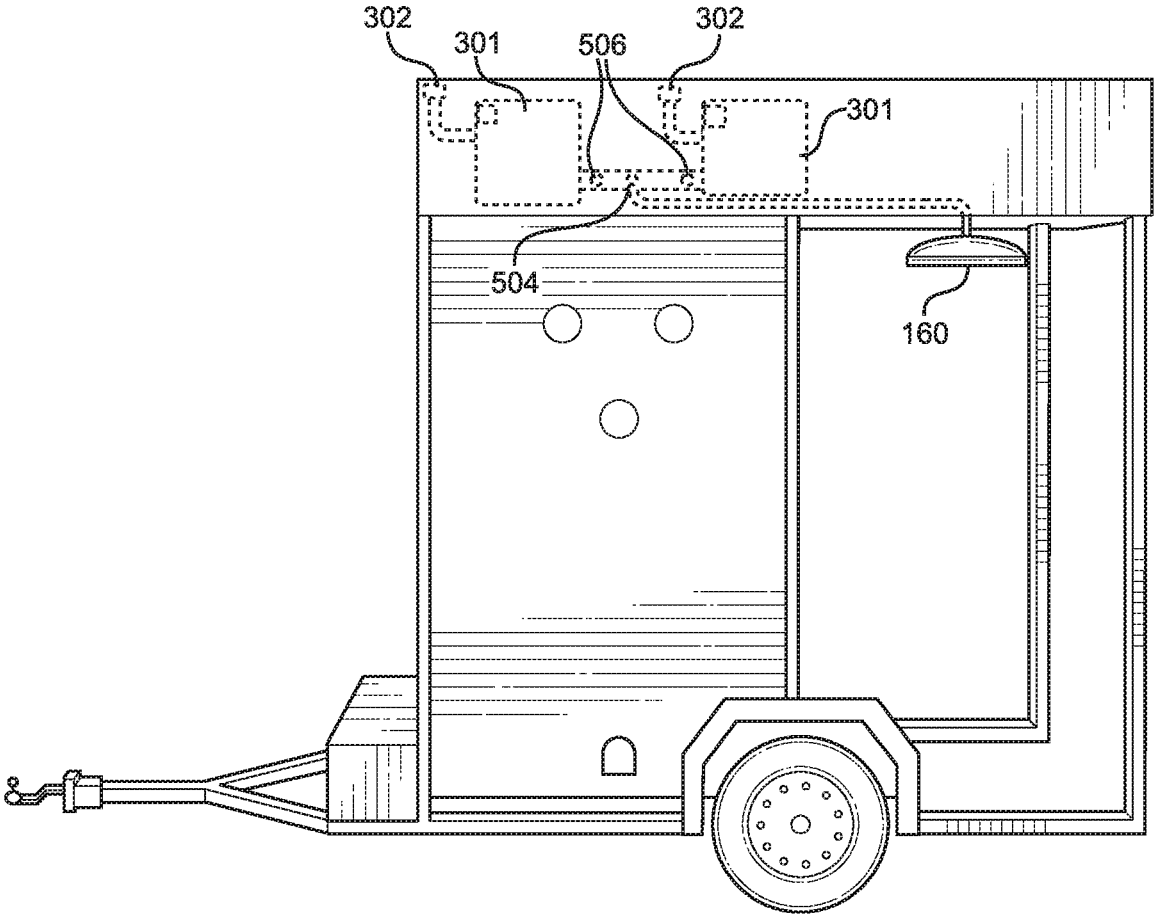
FIG. 3 shows a perspective view of an embodiment of the water tanks of the inverted dunk tank.

The upper section 103 is used to house the internal works of the inverted dunk tank as shown in FIG. 3. The upper section 103 has a base 106 and a plurality of sidewalls 107 raising therefrom. The base 106 and sidewalls 107 are attached to the frame 101. The frame 101 and the base 106 are configured to support the weight of large amounts of water. In one embodiment the upper section 103 will be made from metal. In one embodiment, the upper section 103 is made from plastic or wood. The upper section 103 will house at least one water tank. In one embodiment, the upper section 103 will have a covering that goes over the top of the inverted dunk tank.

A water dispersal head 160 is located directly under the upper section 103. In one embodiment, the water dispersal head 160 is a shower head. In one embodiment, the water dispersal head 160 is an opening. In one embodiment, the water dispersal head 160 is attached to the base 106 of the upper section 103. In this embodiment, a pipe 111 will be fluidly connected through the base 106 of the uppersection 103 to allow water to pass therethrough.

In the illustrated embodiment, a chest 104 is located on the frame 101. In one embodiment, the chest 104 is located on the base of the frame 101. The chest 104 houses a power source 501 for the inverted dunk tank. The chest 104 can further be used to house various spare parts and electric components. In the illustrated embodiment, the chest 104 houses a circuit board 505. The circuit board 505 will control the inverted dunk tank. More about the circuitry will be seen in FIG. 4. In one embodiment, the chest 104 is waterproof.

A wall 105 is attached to the frame 103 of the inverted dunk tank. The wall 105 is a planar wall. In one embodiment, the wall 105 is made of metal. In one embodiment, the wall 105 is made from plastic or other suitable material. The wall 105 has a plurality of apertures 109 there through. The apertures 109 are shown in a triangle configuration however the apertures 109 can be in any configuration. Each aperture 109 have a ball sensor therein. Each ball sensor will be enabled to detect if a ball or other object is passed through the aperture. The apertures 109 can be of various shapes and sizes. Further there is a ball return hole 110 located toward the lower side of the wall 105. This ball return hole 110 will allow balls to be returned to the front of the wall 105 after passing through the apertures 109

Figure 2:
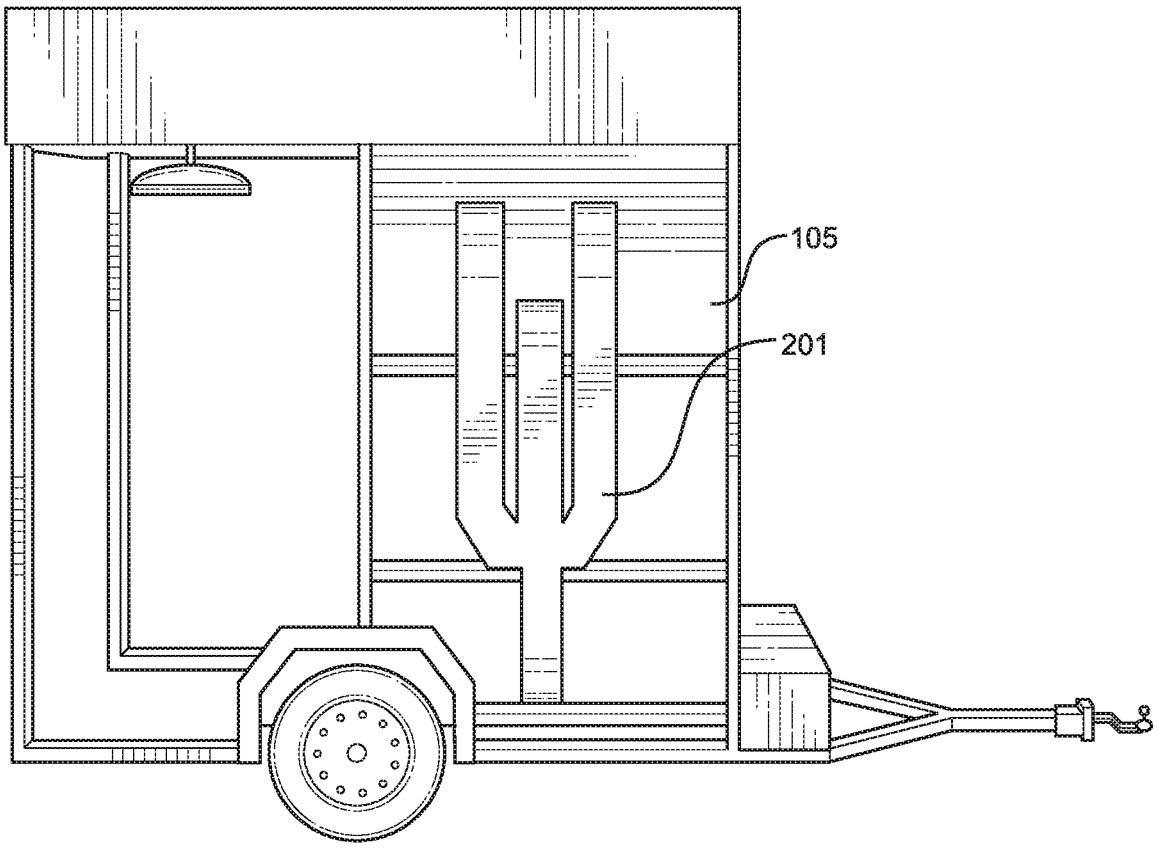
FIG. 2 shows a perspective rear view of an embodiment of the inverted dunk tank.

Referring now to FIG. 2, there is shown a perspective rear view of an embodiment of the inverted dunk tank. From this view a series of pipes 201 are shown attached to the wall 105. The series of pipes 201 are connected at one end to each of the plurality of apertures located through the wall 105. The series of pipes 201 will allow the thrown object to be returned to the front of the inverted dunk tank. In one embodiment, the ball sensors are located within the series of pipes 201. In one embodiment, the series of pipes 201 is metal. In one embodiment, the series of pipes 201 is made from a suitable plastic Specifically, the pipes will connect to each aperture in the wall 105. The pipes 201 will converge to a single pipe before connecting to the ball return hole.

Referring now to FIG. 3, there is shown a perspective view of an embodiment of the water tanks of the inverted dunk tank. There is at least one water tank 301 located in the upper section. In one embodiment each of the at least one water tanks 301 is located in a position forward of the axle of the trailer. This will allow for the trailer to be more stable while towing. Each of the at least one water tanks 301 has a water sensor. The water sensor will detect when the water tank 301 is full. Each water tank 301 will have a set of pipes fluidly connected thereto. A first pipe 302 in each tank is a fill pipe. The firstpipe 302 will be fluidly connected to a fill valve 506. The water tank 301 is fluidly connected to a second pipe. The second pipe is connected to a spill valve 504. This spill valve is fluidly connected to the dispersal shower head 160.

Figure 4:
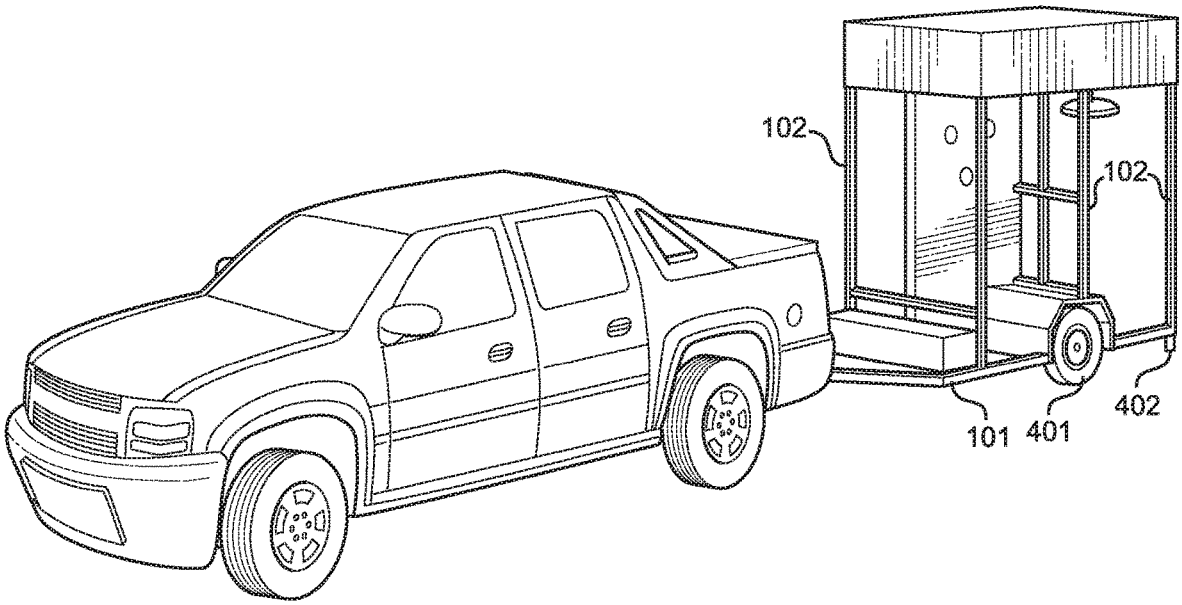
FIG. 4 shows a perspective view of an embodiment of the inverted dunk tank built onto a trailer.

Referring now to FIG. 4, there is shown a perspective view of an embodiment of the inverted dunk tank build onto a trailer. In one embodiment, the inverted dunk tank is built into a trailer. In this embodiment, the frame 101 and the plurality of supports 102 are connected to a trailer base. The trailer base has a plurality of wheels 401. The trailer is configured to be connected to a vehicle. This will allow the device to be transported easily. In one embodiment, there are supports 402 under the trailer to stabilize the inverted dunk tank.

Figure 5:
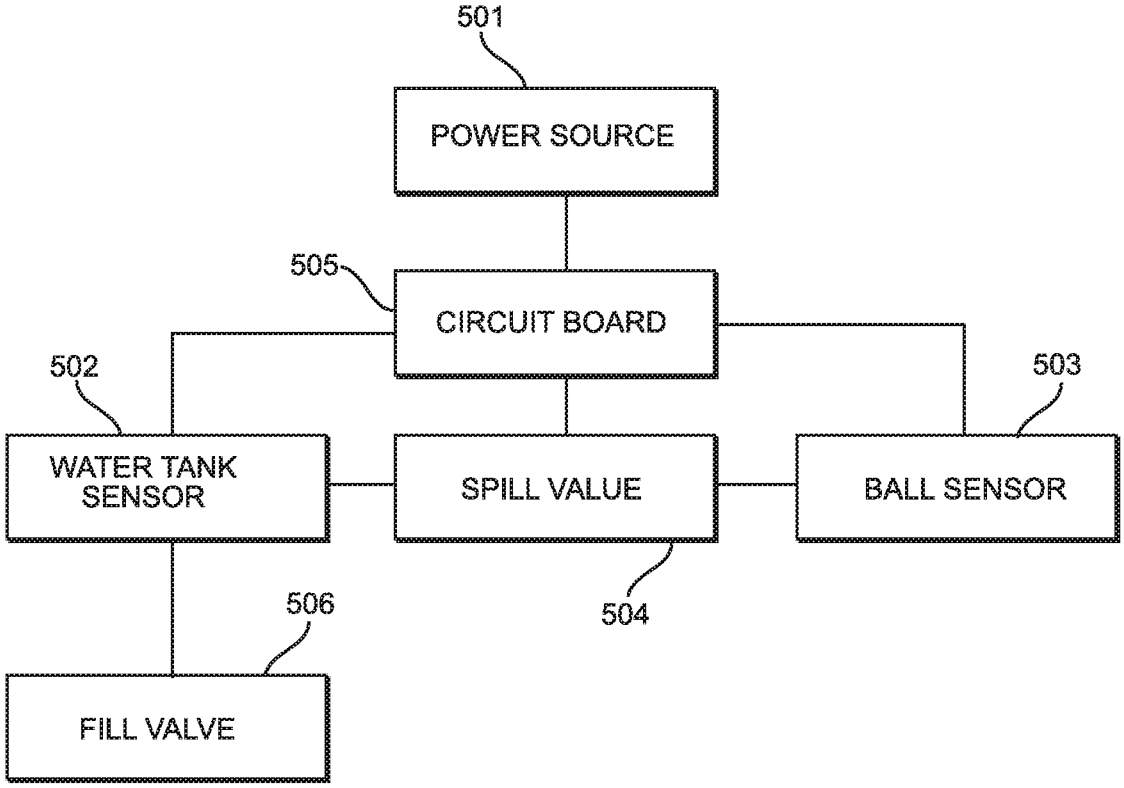
FIG. 5 shows a diagram of an embodiment of the wiring for the inverted dunk tank.

Referring now to FIG. 5, there is shown diagram of an embodiment of the wiring for the inverted dunk tank. There is a power source 501. In one embodiment, the power source 501 is a battery. In another embodiment, the power source 501 is a regulator to connect to an extension cord from an outlet. In a further embodiment, the power source 501 is at least on solar panel. The power source 501 is connected to a circuit board 505. The circuit board 505 is the central control unit. It will connect to a plurality of sensors and valves. Further, the circuit board 505 will direct power to the sensors and valves. The circuit board 505 is connected to at least one water tank sensor 502. The water tank sensor 502 will register when a water tank is filled. The tank will be connected to a fill valve 506. The circuit board 505 and the water tank sensor 502 is connected to the spill valve 504. The spill valve 504 will only release water if the tank is registered as full. Once the tank is registered as full the tank sensor 502 will deactivate until the water is released from the tank. This will ensure that the tank is completely emptied when the spill valve 504 is tripped. The spill valve 504 is connected to a ball sensor 503. The ball sensor 503 is also connected to the circuit board 505. The ball sensor 503 will detect when a ball passes through one of the apertures and will signal a water release to the spill valve 504. Once a tank is emptied the water tank sensor 502 will send a signal to the fill valve 506.

It is therefore submitted that the instant invention has been shown and described in what is considered to be the most practical and preferred embodiments. It is recognized, however that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inverted dunk tank, comprising:

a frame, wherein the frame defines an area for an individual to be placed;

a water tank located in an upper section of the frame;

a water release valve connected to a bottom section of the water tank;

a wall attached to a side section of the frame;

wherein the wall has a plurality of apertures therethrough;

wherein each aperture has a sensor that detects when an item is passed through an aperture;

wherein the sensor of each aperture is operably coupled to the water release valve;

a tank sensor attached to the water tank, wherein the tank sensor is configured to detect when a water tank is full, wherein the water release valve is operably coupled to the tank sensor, wherein the water release valve only opens if the tank sensor sends a tank full signal.

2. The inverted dunk tank of claim 1, further comprising a power source to power the sensors and valves.

3. The inverted dunk tank of claim 1, further comprising a series of pipes connected to each of the plurality of apertures, wherein the pipes allow objects to be returned to a front side of the wall through a ball return pipe and an aperture located at a lower end of the wall.

4. An inverted dunk tank, comprising:

a frame, connected to a trailer, wherein the trailer is capable of attaching to a vehicle;

a water tank located in an upper section of the frame;

a water release valve connected to a bottom section of the water tank;

a wall attached to a side section of the frame;

wherein the wall has a plurality of apertures therethrough;

wherein each aperture has a sensor that detects when an item is passed through the opening of an aperture;

wherein the sensor of each aperture is operably coupled to the water release valve;

a tank sensor attached to the water tank, wherein the tank sensor is configured to detect when a water tank is full, wherein the water release valve is operably coupled to the tank sensor, wherein the water release valve only opens if the tank sensor sends a tank full signal.

5. The inverted dunk tank of claim 4, further comprising a power source to power the sensors and valves.

6. The inverted dunk tank of claim 4, further comprising a series of pipes connected to each of the plurality of apertures, wherein the pipes allow objects to be returned to a front side of the wall.

7. An inverted dunk tank, comprising:

a frame;

a first water tank located in an upper section of the frame;

a first water release valve connected to a bottom section of the first water tank;

a second water tank located in the upper section of the frame;

a second water release valve connected to a bottom section of the second water tank a wall attached to a side section of the frame;

wherein the wall has a plurality of apertures therethrough;

wherein each aperture has a sensor that detects when an item is passed through the opening of an aperture;

wherein the sensor is operably coupled to each of the water release valves;

a first tank sensor attached to the first water tank, wherein the first tank sensor is configured to detect when the first water tank is full, wherein the first water release valve is operably coupled to the first tank sensor, wherein the first water release valve only opens if the first tank sensor sends a tank full signal.

8. The inverted dunk tank of claim 7, further comprising a power source to power the sensors and valves.

9. The inverted dunk tank of claim 7, further comprising a second tank sensor attached to the second water tank, wherein the second tank sensor is configured to detect when the second water tank is full.

10. The inverted dunk tank of claim 9, wherein the second water release valve is operably coupled to the second tank sensor, wherein the second water release valve only opens if the second tank sensor sends a tank full signal.

11. The inverted dunk tank of claim 7, further comprising a series of pipes connected to each of the plurality of apertures, wherein the pipes allow objects to be returned to a front side of the wall.

* * * * *